US009054405B2

(12) United States Patent
Harris

(10) Patent No.: US 9,054,405 B2
(45) Date of Patent: Jun. 9, 2015

(54) APPARATUS AND METHOD FOR A VARIABLE-RATIO ROTATIONALLY-POLARIZED HIGH POWER INDUSTRIAL MICROWAVE FEED NETWORK

(76) Inventor: George Harris, Auburn, ME (US)

( * ) Notice: Subject to any disclaimer, the term of this patent is extended or adjusted under 35 U.S.C. 154(b) by 258 days.

(21) Appl. No.: 13/464,606

(22) Filed: May 4, 2012

(65) Prior Publication Data

US 2013/0120085 A1 May 16, 2013

Related U.S. Application Data

(60) Provisional application No. 61/482,316, filed on May 4, 2011.

(51) Int. Cl.
*H01P 1/165* (2006.01)
*H01P 5/08* (2006.01)

(52) U.S. Cl.
CPC ..... *H01P 1/165* (2013.01); *H01P 5/082* (2013.01)

(58) Field of Classification Search
USPC ..... 333/21 R, 21 A
See application file for complete search history.

(56) References Cited

U.S. PATENT DOCUMENTS 3,517,341 A * 6/1970 Augustin ..... 333/21 R
3,569,870 A * 3/1971 Foldes ..... 333/21 R
4,809,357 A * 2/1989 Vaughan ..... 455/129

* cited by examiner

*Primary Examiner* — Stephen E Jones
*Assistant Examiner* — Scott S Outten
(74) *Attorney, Agent, or Firm* — Robert L. Shaver; Shaver & Swanson, LLP

(57) ABSTRACT

Disclosed is a waveguide for even dispersion of microwaves into a microwave chamber. The microwaves are dispersed in a manner that the target in the microwave chamber does not need to be turned in order to accomplish even and uniform heating of the target. The waveguide includes a first rectangular section adjacent to the source, and a second rectangular section which is sized to separate, disperse and randomized microwaves received from the first waveguide.

1 Claim, 5 Drawing Sheets

APPARATUS AND METHOD FOR A VARIABLE-RATIO ROTATIONALLY-POLARIZED HIGH POWER INDUSTRIAL MICROWAVE FEED NETWORK

TECHNICAL FIELD

The invention relates to microwave feed networks, and more particularly to microwave feed networks which split microwave energy into multiple phases.

BACKGROUND

More and more industrial processes either are benefiting, or will be able to benefit further by using or introducing high power microwave technology into their manufacturing processes. Much of the benefit will come in the pre-cooked food processing area, as well as processes such as microwave sterilization and/or pasteurization, de-watering, heating, blanching and curing. Traditionally, high power microwaves are used to either soften hard-frozen blocks of food such as meat products in order to allow them to be sectioned and processed prior to either sale as frozen food products, or further processed. Other industrial microwave applications actually involve cooking the product prior to sale.

These food products range from pre-cooked bacon, meat and poultry products. Other food products include vegetables such as potatoes and beans in many varieties of process configurations. In addition to industrial food processes, there are also many, many non-food industrial microwave applications including building materials manufacturing like laminated veneer lumber and plywood.

In all of these applications, a means must be provided that allows the high power microwaves to be applied to the product. Traditionally, this was done by simply conveying the high power microwaves in a conduit such as waveguide from the high power microwave generator or transmitter to the microwave cavity where the products are exposed to the power flux and processed. This technology first saw wide use back in the late 1960's and 1970's. Then, the microwaves were introduced into a large open cavity where the inside physical dimensions of the microwave cavity were several times larger than the wavelength of the microwaves being used. This was done by design, in order to allow the microwaves inside of the cavity, (where the food or other products were usually conveyed inside the cavity volume by a continuous conveyor belt, or simply placed there in a batch process configuration).

The microwaves were introduced into the cavity, in most cases, by a simple, open-ended waveguide section, and allowed to "bounce" around inside of the microwave cavity. In this way, the process substrate inside the cavity would "swerve into" the high-energy microwave fields and be heated or otherwise processed. Specific systems of propagating microwave electric and magnetic fields are called "Modes". Depending on many factors inside, especially the physical size of the cavity, these microwave modes can take on a variety of shapes and configurations. The greater the number of modes, the higher the statistical likelihood that the process product inside of the microwave cavity would encounter the microwave fields and be cooked or otherwise processed. As the number of microwave field configurations was increased, the probability of achieving a satisfactory process result was increased also. In the early days in order to get these microwaves bouncing all over the place, Raytheon developed a motorized wave guide antenna almost like radar. They actually called it a radar ring. It had a gear motor that turned the radar ring around at about one revolution a second, and it sprayed the microwaves down onto the food or into the cavity very much like a shower. Essentially, they had a microwave shower nozzle that physically rotated. The result was that when the food was going through sometimes it got sprayed and sometimes it didn't.

The physical dimensions of a microwave cavity as compared to the frequency, and therefore the wavelength of the microwaves, is the major determinant in how many of these different modes will be able to exist in the interior of a specific cavity's volume. In nearly all traditional industrial systems, the microwaves were simply "sprayed" into the cavity by an open-ended section of rectangular waveguide, and allowed to bounce around inside. The goal was to introduce the microwaves into the cavity so that a maximum number of microwave modes would be excited. In order to have the best chance of exciting the maximum number of microwave modes inside of the cavity, the microwaves were usually introduced through a rotating flat disk, upon which were usually three open-ended waveguide sections, set at approximately 120 degree angular displacements around the disk's edge, and then fed from the center. The disk was connected to a gear motor and physically rotated inside of the cavity. (The goal is the same as that accomplished by the turntable inside of a home microwave oven.)

This design approach worked, however, there are many problems associated with this feed configuration. First, as time passed and the technology became more sophisticated and the microwave power levels continued to increase, the motorized rotary feed system became increasingly vulnerable to high power microwave burn-outs due to the ever-increasing microwave power levels. Secondly, many industrial microwave processes involve the generation of cooking by-products such as grease or fat from the process. This was a continuous problem because it would usually accumulate over time inside of the rotating components of the rotary feed, heating up in the high power microwave fields and eventually burn out, often destroying the rotary feed network.

Thirdly, the gear motor's rotation speed was quite slow, and the number of possible microwave mode events inside of the cavity during the time the food or other process products were inside to be cooked or processed was correspondingly slow as well.

This would oftentimes lead to inconsistent and sometimes unpredictable process results.

SUMMARY OF THE DISCLOSURE

Figure 1:
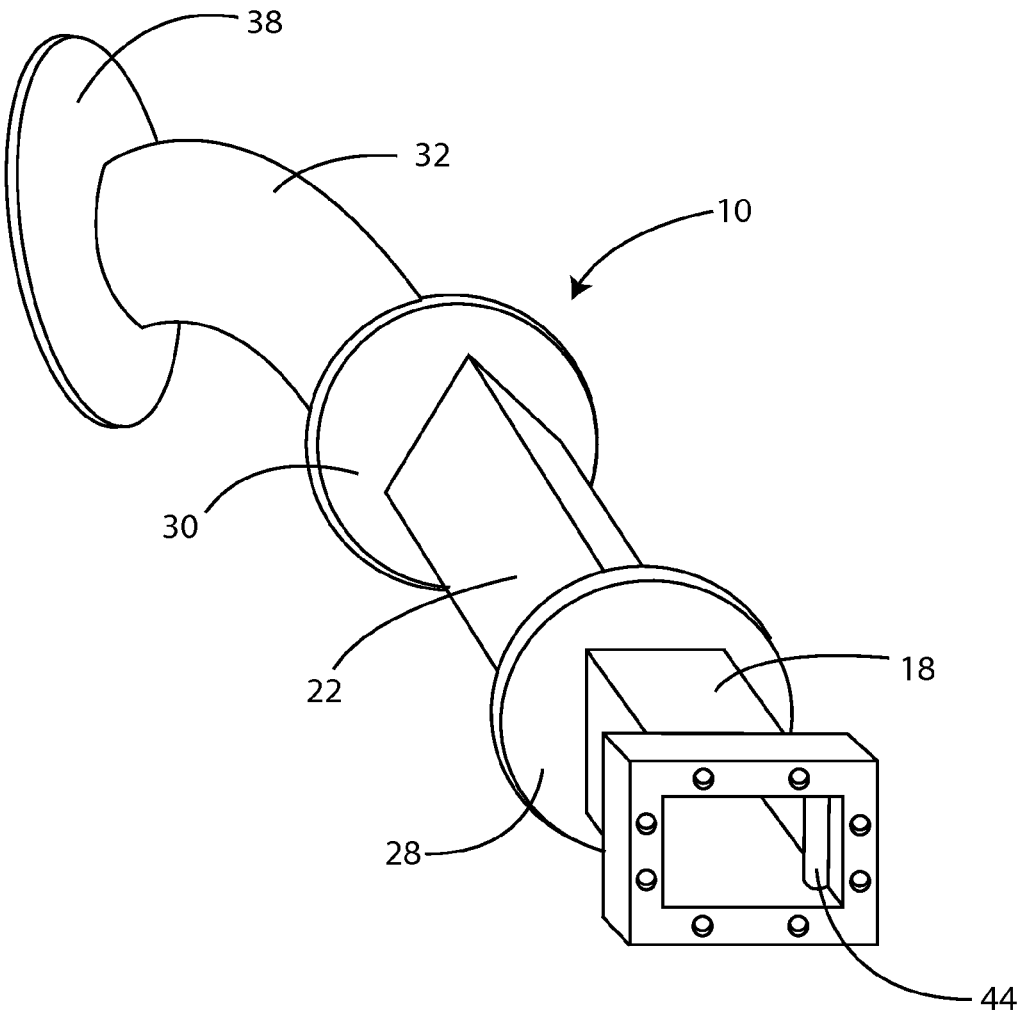
FIG. 1 is a perspective view of the disclosed microwave feed network.

This invention covers an Apparatus and a Method for the highly efficient and reliable means of introducing microwaves into the interior volume of a microwave cavity in a way that allows a much larger and more reliable excitation of multiple microwave modes within a microwave cavity, over that observed using the older gear-motor type rotary microwave feed devices. In addition, this Invention does not use any moving parts and is highly power-tolerant, reducing the possibility of burn-out events from the normally high power levels required in most industrial microwave applications.

The disclosed technology includes a microwave applicator that sprays microwaves in all directions at the same time, almost like a fine mist. With this kind of delivery of microwave energy, there is no need for a gear motor, eliminating one thing that can malfunction. An applicator using this technology sprays microwaves in all directions, practically at the same time by allowing the microwaves to come out of the circular cross section wave guide, spinning at a rotational speed that is equal to the microwave frequency of operation.

The device is made up of a first waveguide, which is rectangular. It is attached to a second rectangular waveguide, which is turned at an angle, typically a 45 degree angle to the first waveguide. The result of the partially rotated $2^{nd}$ waveguide is that when $TE_{10}$ microwave energy from a microwave source is directed into the first waveguide, it is passed as $TE_{10}$ energy into the second waveguide. In the second waveguide, some of the energy hits the sidewall on one side of the sidewall corner presented to the energy, and some of the energy hits the sidewall on the opposite side of the corner. TE means Transverse Electric mode. The 10 means one half period variation of electric field in the x direction and the 0 means zero half period variations of field in the y direction. It defines how the microwaves are propagating through that pipe. Inside the first rectangular waveguide is a piece of material called a tuner. The tuner is placed on the broad wall of the first waveguide. The size and position of the tuner is calculated to provide a perfect match between the microwaves and the generator and the microwaves going through this device and into the cavity. The tuner is placed based on measurements of reflectance of microwave energy coming back from the cavity. The waveguide feed network is connected to one wall of the cavity, which can be the top walls, side walls or bottom walls of the cavity. Attached to the feed network is a microwave generator at one end and a cavity at the other end.

The tuner can be a capacitive tuning structure. It can also be an inductive tuning structure, or it may be resistive in nature. The capacitive tuning structure always acts on magnetic fields. The inductive tuning structure is basically pieces of rods that are attached at the broad top wall to the broad bottom wall in the first rectangular waveguide. The type of tuner used is based on the type of microwave system that is being designed. The relative size of the waveguides is critical, but the relative size of the flanges connecting them is not critical. The ratio and the length of the rectangular waveguides and the frequency are adjusted so that at circular waveguide the electric field and the horizontal field in the vertical direction are 90 degrees out of phase.

The length of the waveguides can be adjusted so that you can get different ratios, so the wave patterns may not always 90 degrees different, and 80 degrees or 70 degrees or 100 degrees differences are possible. This is the variable ratio aspect of the device. When the second waveguide is 45 degrees off from the first waveguide, the resulting fields will be split into 90 degrees different fields. The length and the aspect ratio of the wave guides are adjusted so that you get the ratio of horizontal field to vertical field. The second waveguide has the aspect ratio and the length very carefully adjusted so that the electric fields are 90 degrees out of phase, and the 45 degrees relative orientation gives the system half the electric field to horizontal and half vertical directions as the energy exits the second waveguide.

The system may direct the microwave energy directly into the cavity from that point, or there may be a third waveguide that directs the energy into the cavity. The third waveguide is a circular cross section wave guide, which may be straight or curved into an elbow shape. What comes out of the second waveguide is rotationally polarized, TE Rotationally Polarized microwave energy. If routed through a third waveguide, it is still TE Rotationally Polarized energy, with the circular third waveguide providing only transport to the energy.

The broad wall width actually controls the propagation velocity or the phase velocity. The broad wall widths are adjusted so that one $TE_{10}$ system of fields propagating in zero degrees and then the orthogonal $TE_{10}$ system of fields over that length, one is 90 degrees ahead of the other. And the 90 degrees phase relationship between the horizontally and vertically oriented electric fields by definition is the rotational polarization. The result is that the microwave fields after the second waveguide are spinning and split into a randomized field of energy.

The core Technology of this Invention relies on the waveguide wavelength propagating in the $TE_{10}$ Rectangular Waveguide Mode as determined by its Broad-Wall Rectangular Waveguide Dimension. Two Orthogonal Systems of Microwave Fields propagating in the $TE_{10}$ Rotationally Polarizes mode, in the same rectangular waveguide section of waveguide are excited. The Invention incorporates a rectangular waveguide section with its Aspect Ratio and Length adjusted such that ONE of the two systems of Orthogonal Fields propagating in the TE Mode, directed at the Input End of the Invention, will arrive at the Output End of the Invention 90 degrees either LEADING the other system of Fields propagating in the $TE_{10}$ Mode or LAGGING the other system of Fields propagating in the $TE_{10}$ Mode, when evaluated at a fixed longitudinal location at the Outfeed End of the Invention.

This will result in the desired rotating Field Configuration; a Rotationally-Polarized System of Fields. This System of Fields will be either right-hand or left-hand Rotationally-Polarized, depending on the Aspect Ratio of the Rectangular Waveguide Section of the Invention, as well as the Angle of Orientation of the wider Broad-Wall Section of the Invention relative to the Broad Wall Dimension of the rectangular waveguide connected to and feeding the Input End of the Invention. The Axial Ratio at the Out-Feed of the Invention may be continually adjustable by incorporation of an angularly-variable connection point between the rectangular waveguide feeding the Invention and the Broad-Wall of the Invention. The overall LENGTH and Aspect Ratio of the Invention is adjusted so that an acceptable Axial Ratio Variation of the propagating system of fields at the Out-Feed End of the Invention is maintained over the expected or required microwave frequency bandwidth.

What happens is that the microwave inside the second waveguide section, propagate at different phase velocities. The length of that is adjusted so that the electric fields pointed in the horizontal direction are 90 degrees (for example) out of vase with the electric fields pointed in the vertical direction.

PREFERRED EMBODIMENTS

Figure 2:
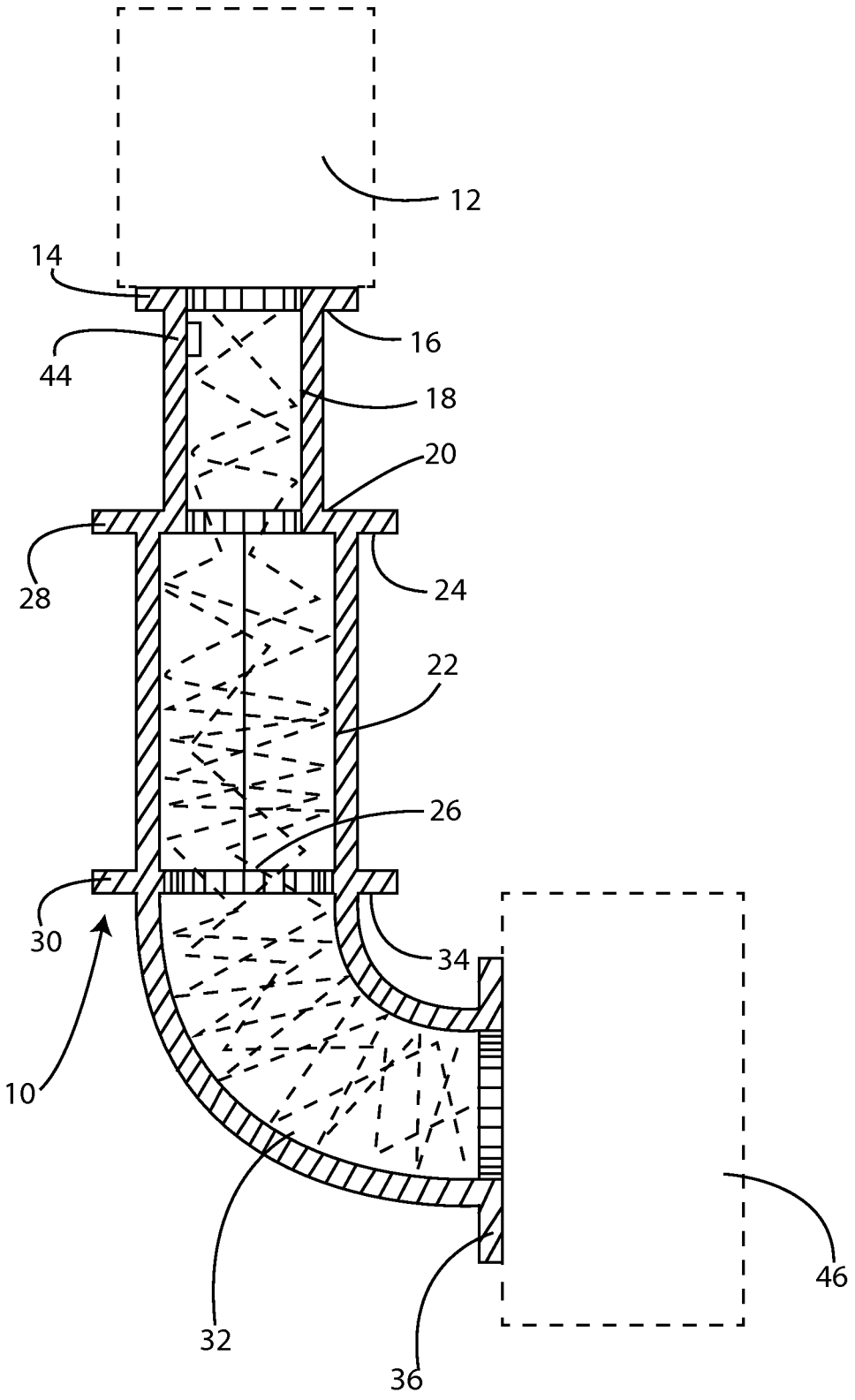
FIG. 2 is a side view of the disclosed microwave feed network.
Figure 3:
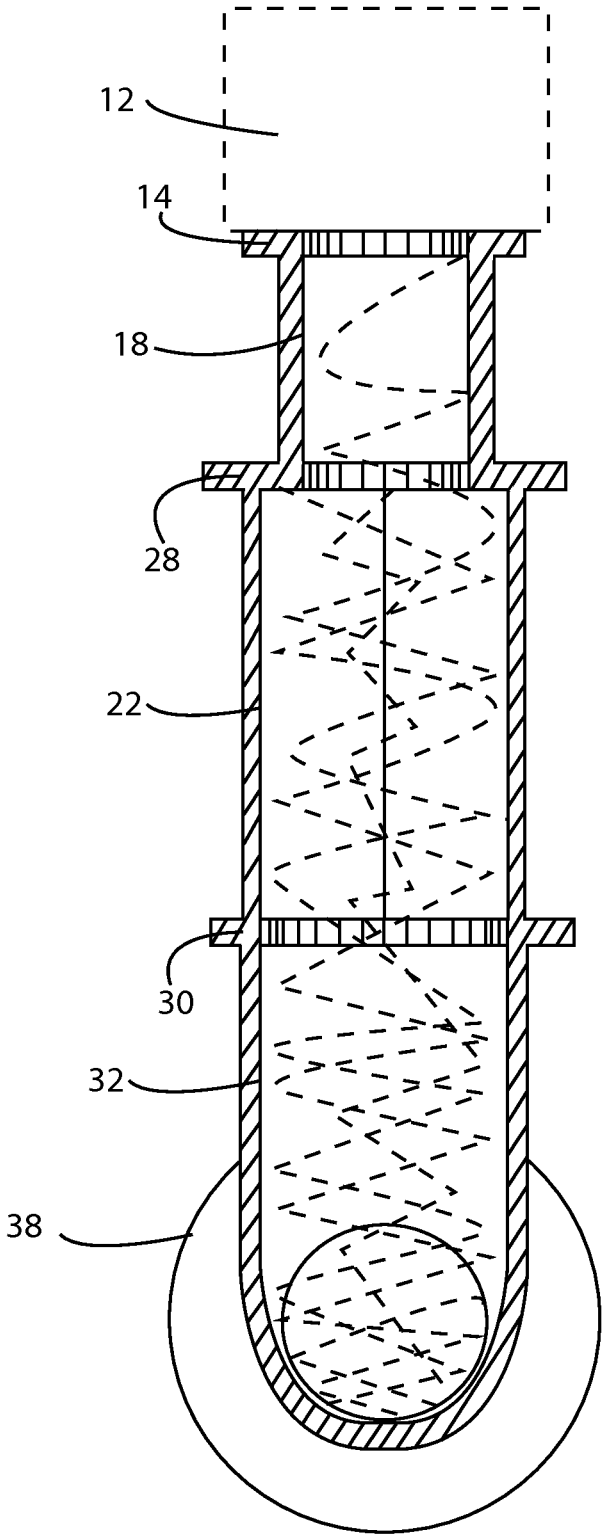
FIG. 3 is a top view of the disclosed microwave feed network.

Shown in FIG. 1 is an example of the disclosed rotationally polarized microwave feed network 10. Although this structure could be modified infinitely according to the requirements of a specific job, to present an example of a typical installation, the following example system is described. FIGS. 1, 2 and 3 show the example described below. FIG. 2 is the side view and also shows an approximation of the paths of the microwave field inside the waveguides. FIG. 3 is a top view of the same system which is described in the paragraphs below.

An exemplary but not exclusive installation of the technology would include a microwave source 12 with an output of from zero to several kilowatts, megawatts or more. Here, the microwaves from the generator are carried through the rectangular input waveguide in the $TE_{10}$ Mode, in which TE stands for Transverse Electric. The "1" in the "10" subscript refers to one half-period variation field in the X direction and the "0" refers to one half-period of field in the Y Direction.

Attached to the microwave source is a first flange 14. The first flange 14 is from 0.062 inches or less to 0.500 inches or more thick, and is typically 0.75 inches thick, and provides a transition from the microwave source 12 and the inlet 16 of the first rectangular wave guide 18. These flanges can, but are not required to be in accordance with Industry Standards for waveguides. The first rectangular waveguide 18 is attached to the first flange 14.

Like the first flange 14, the first rectangular waveguide 18 can be of aluminum, but could be made of copper, stainless steel or any conducting material, and can be approximately from 0.062 inches to 0.500 inches or more thick. The first rectangular waveguide 18 is rectangular in cross section, with the dimensions of the sidewalls determined by the microwave or RF wavelength and the power level required in the application. The sidewalls are designated the broad walls and the short walls, to differentiate the broader pair of walls from the shorter walls. The sidewalls are made of the same selection of materials in this example, and of the same thickness. In this example, the broad side walls of the first rectangular waveguide are approximately 9.75 inches tall, and the short side walls are 4.875 inches tall, and the wave guide is a minimum of 1.25 waveguide half-wavelengths long at the center frequency. These dimensions are determined by the requirement for enough waveguide space for the placement of any impedance matching structures, called tuning structures or tuners, shown as 44 in the figures, if needed. In this example, when operating at a center frequency of 915 MHz, the minimum length of this Waveguide Section is 10.75 inches long. (915 MHz, and with the broad-wall waveguide dimension being 9.75 inches, the wavelength in this waveguide of this 915 MHz microwave energy is calculated to be approximately 17.2 inches. One half wave length is therefore 17.2 inches divided by 2, equaling approximately 8.6 inches. Finally, this half-wavelength of 8.6 inches multiplied times 1.25 equals 10.75 Inches. Microwaves enter the first rectangular waveguide 18 in the form of $TE_{10}$ Mode energy, and are not changed in this section of the invention. The effect of this wave guide on the microwave energy is to transmit the energy to the second waveguide section 22. The outlet end 20 of the first rectangular wave guide is attached to a second flange 28, again providing a transition from one wave guide to another. In this case the outer shape of the second flange 28 is circular, with a rectangular opening the same size as the interior of the first rectangular wave guide 18, and is approximately five-eighths of an inch thick, although this dimension nor the circular shape of the second flange 28 is not critical. The size of the sidewalls are standard waveguide sizes for this particular wavelength energy.

The next component is the Second Rectangular Waveguide Section 22, which has an inlet end 24, and an outlet end 26. The second rectangular waveguide section 22 is also the called the Orthogonal-Phasing/Delay Waveguide Section, because in this waveguide the energy is split into two orthogonal (right angle) planes with a difference in the phase velocity between the two systems.

The Second Rectangular Waveguide Section 22, which in this example is made of 6061 T-6 Aluminum Alloy, and is from less than 0.062 to more than 0.500 inches thick. The Second Rectangular Waveguide Section 22 is attached to the second flange 28 at its inlet end 24, and is attached to a third flange 30 at its outlet end 26. The second flange 28 and third flange 30 are both typically aluminum and from less than 0.062 to more than 0.500 inches thick, and can be made of the same material as the first flange 14, and provides a transition from one waveguide to another. The flanges do not add any microwave modification, but serve as physical structure which allowed the other parts to be joined, and provide a transition from one waveguide to the other.

The second waveguide 22 is rectangular in cross section, and turned 45 degrees for instance from the orientation of the first waveguide 18. The dimensions of the sidewalls are determined by the relative waveguide wavelengths at the center operating frequency. The sidewalls are made of the same material as previously presented, in this example from less than 0.062 to more than 0.500 inches thick. In this example, the taller side walls are 9.75 inches in tall, the same dimension as the taller walls of the first waveguide, and the shorter side walls are 8.46 inches tall, and the second wave guide is 26 inches long. The length of the waveguide is selected so that the difference in phase at the outlet end is 90 degrees out of phase. The difference in size between the two sidewalls determines the different in phase velocity when the fields reach the outlet of the second waveguide 22. There are two orthogonal $TE_{10}$ Mode guided microwave signals in the second waveguide section 22. One of the two $TE_{10}$ Mode guided microwave signals is propagating in the second waveguide 22 whose broad-wall dimension is 9.75 inches, and the second, orthogonal $TE_{10}$ Mode guided microwave signal is propagating in the second waveguide 22 whose broad-wall dimension is 8.46 inches. In this example, the second waveguide 22 section being 26 inches long, one of the two orthogonal, propagating TE Rotational Polarized Mode microwave signals arrives at the output end of Waveguide section 22 90 degrees delayed relative to the other. Microwave entering the second rectangular waveguide 22 is in the form of $TE_{10}$ Mode energy, and the energy exiting the second rectangular waveguide 22 is in the form of Rotationally-Polarized TE Mode energy. The effect of this second wave guide 22 on the microwave energy has been to set up two separate systems of fields whose Electric Field Components are orthogonal (90 degree) to one another, and delayed in transmission phase by 90 degrees. The result of this orientation at the Output End 26 of the Second waveguide section 22 is a rotating system of fields, spinning at the operating frequency, (in this example, 915 Million rotations per second), ensuring that the relative transmission phases of the two propagating systems of microwave fields in the $TE_{10}$ Mode in the Second waveguide section 22 arrive at the Output End 26 of the Second waveguide section 22 in phase quadrature, meaning 90 degrees difference in phase. One could call the microwave energy exiting the second waveguide section 22 a randomized spray, with no energy voids. For this reason, rotation of the product under this form of microwave energy is not necessary. With no rotation of the product, moving parts and motors are eliminated.

Although the second waveguide section 22 is shown at 45 degrees to the first waveguide, other angles between the two rectangular waveguides are possible, from less approximately 10 to approximately 80 degrees off the angle of the first waveguide section 18.

The relative Magnitudes of the two plane waves, launched at the INPUT end of the horizontal and vertical plane in the Orthogonal-Phasing/Delay Waveguide Section (second waveguide 22) will also depend on the angle between the planes of the Orthogonal-Phasing/Delay Waveguide Section 22 and the standard waveguide section 18 at the Input End 24.

The operation is based on the relative phases of the V-Plane, (Vertical), and H-Plane, (Horizontal), $TE_{10}$ waveguide fields in the Phasing/Delay Waveguide Section (second waveguide 22), as the two systems of fields arrive at the output end of this second waveguide section 22. The aspect ratio of that Section in conjunction with its length is adjusted so that the V-Plane and H-Plane waves arrive at the circular-cross-section output end, delayed in phase by 90 degrees. The 90 degree relative phase difference at the output, (circular cross-section), end of the Feed will result in equal-magnitude E-Plane and H-Plane electric field intensities that are orthogonal in orientation and in phase quadrature, (90 degrees). This results in Rotational-Polarization.

The outlet end of the second rectangular wave guide 22 is attached to a third flange 30, again providing a transition from one wave guide to another. In this case the third flange is circular in its outer shape, with an opening the same size as the interior of the second rectangular wave guide, and in this example, approximately 0.75 inches thick, although this dimension nor the circular shape of the outside or outer circumference of the flange is not critical.

The second wave guide 22 between the two flanges is 45 degrees to the first wave guide 14. What happens is the broad wall width of the second wave guide 22 actually controls the propagation velocity or the phase velocity. The broad wall widths are adjusted so that one $TE_{10}$ system of fields propagating in zero degrees and then the orthogonal $TE_{10}$ system of fields over that length, one is 90 degrees ahead of the other. The 90 degrees phase relationship between the horizontally and vertically oriented electric fields by definition is the rotational polarization.

The third waveguide 32 is circular in cross section and curved to form an elbow, which in this example is made of the same material and thickness as earlier presented. The third waveguide 32 has an inlet end 34 and an outlet end 36. The circular elbow waveguide 32 is attached to the third flange 30 at its inlet end 34. The circular waveguide is 9.75 inches in diameter in this example, with the other dimensions of the circular waveguide being determined by the specific mechanical requirements of the application. The sidewall material and thickness of the circular waveguide section 32 are the same as those previously presented. In this example, the curved wave guide turns the microwave energy 90 degrees, and is approximately 15 inches from inlet to outlet. Microwave energy entering the circular waveguide is in the form of TE Rotationally-Polarized Mode Microwave Energy, and the energy exiting the second rectangular waveguide is in TE Rotationally-Polarized Mode Microwave Energy as well. The circular cross-section waveguide 32 can be any angle from zero, (straight), to 90 or more degrees. The third waveguide 32 does not modify the microwave energy, and only serves to direct the energy to a microwave chamber 46. The third waveguide 32 could thus be straight, curved, could be of any length, or could be eliminated.

The outlet end 36 of the circular wave guide 32 is attached in this case to a fourth flange 38, again providing a transition structure and a means of physical attachment. In this case the fourth flange has a passage which is circular, the same diameter as the interior of the third waveguide 32, and in this case the outside dimension is circular, and could be 0.75 in thick, although this dimension nor the circular shape of the flange is not critical. From the fourth flange, microwave energy enters a microwave chamber in the form of Rotationally Polarized $TE_{10}$ energy, with the rotation of the fields being similar to a random spray of microwave energy, with no energy voids. The type of microwave guide that goes into the first wave guide 14 is $TE_{10}$ and what comes out of the third waveguide 32 is the TE Rotationally Polarized.

Figure 4:
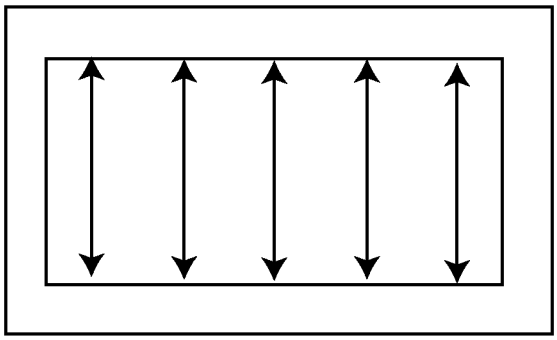
FIG. 4 is an end view of the first rectangular waveguide.
Figure 5:
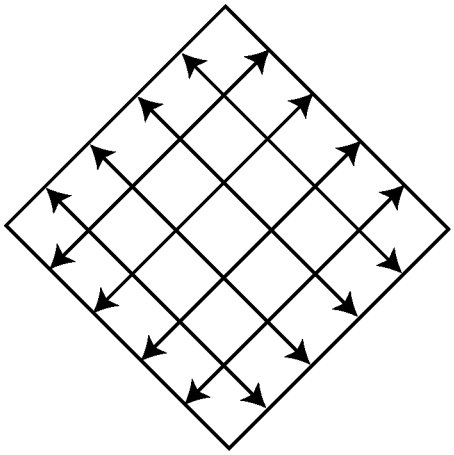
FIG. 5 is an end view of the second rectangular waveguide.

FIG. 4 is an end view of the waveguide section 22. The double headed arrows and lines indicate the electric field lines of the two orthogonal TE10 modes. The splitting into two modes is caused by the different orientation of the first waveguide from the second waveguide.

Figure 6:
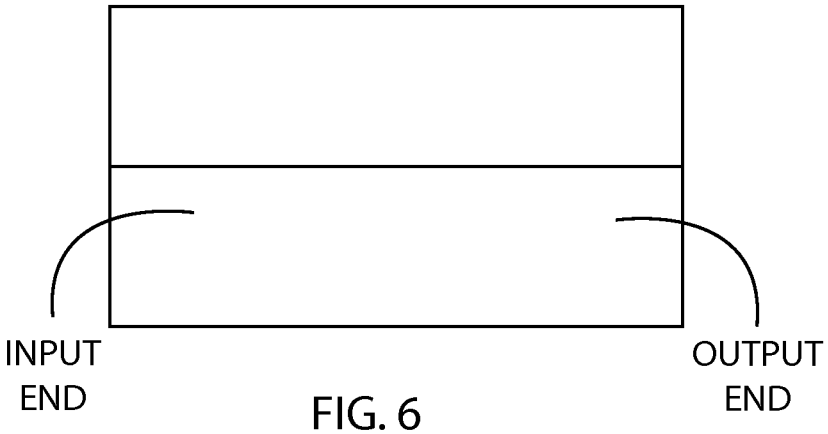
FIG. 6 is a side view of the second rectangular waveguide.
Figure 7:
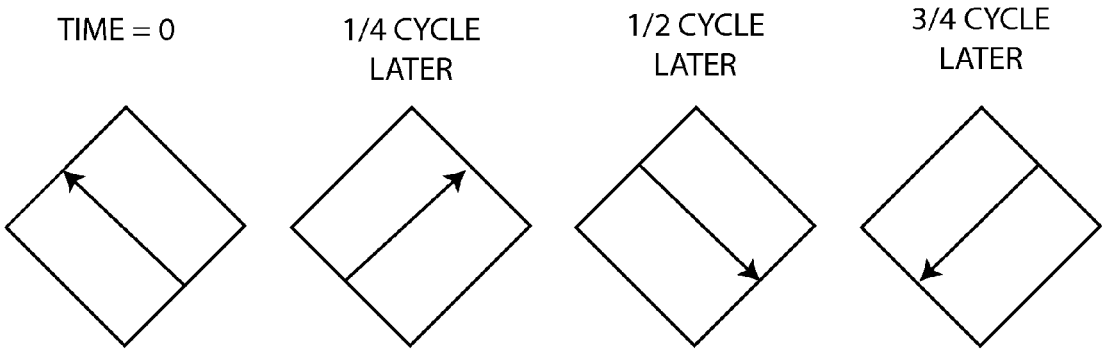
FIG. 7 is an end view of energy in the second rectangular waveguide.

FIG. 6 shows a side view of the waveguide 22. Since the two orthogonal te10 modes are propagating with different phase velocities, the te10 modes propagating with the broad-wall dimension of 8.46 inches arrive at the "outlet end" first, one quarter of a cycle, (90 degrees) ahead of the other te10 mode propagating with its broad-wall dimension of 9.75 inches. The result of this delay plus splitting into two different phases is shown in FIG. 7. The first square represents times 0 looking at an end view of the output end of the second waveguide 22. The second rectangle represents the end view of that wave guide one quarter cycle later. The third square represents the output end of that waveguide one half-cycle later, and the fourth square represents an end view of the output end of the second waveguide three quarter of a cycle later. The result of the delay and the splitting is that the microwave energy is rotating rapidly, and arrives into the microwave chamber in a thoroughly dispersed manner.

The disclosed microwave applicator sprays microwaves in all directions at the same time, almost like a fine mist. There is no gear motor to burn out and it has fewer moving parts. There is no gear motor. It sprays microwaves in all directions and practically at the same time by allowing the microwaves to come out of the round opening of the third waveguide 32.

The invention claimed is:

1. A waveguide network for directing microwave energy from a microwave source to a microwave cavity, comprising:

a first rectangular waveguide for receiving microwave energy from said microwave source, said first rectangular waveguide with an open input end, an open output end, and four sidewalls forming a rectangular cross section waveguide body, attached to an outlet side of a first flange, with said first flange attached to said microwave source, or additional connecting waveguide, with a second flange attached to said output end of said first rectangular waveguide, with the length of said first rectangular waveguide being half a wavelength times 1.25;

a second rectangular waveguide attached to an outlet side of said second flange, with an open inlet end and an open outlet end, and four sidewalls forming a rectangular cross section waveguide body with the cross sectional rectangle waveguide body oriented at approximately 45 degrees to the angle of rectangular waveguide body of said first waveguide, with said outlet end of said second rectangular waveguide attached to an inlet side of a third flange, with the length of the second waveguide being selected so that two separate systems of fields are 90 degrees out of phase at an outlet end;

with said second rectangular waveguide oriented to deflect a first portion of entering $TE_{10}$ Mode energy off one sidewall of said second rectangular waveguide in a first direction, and with a second sidewall oriented to deflect a second portion of said entering energy in a second direction, with said orientation of said waveguides constructed to produce TE rotationally polarized mode microwave energy when $TE_{10}$ energy is input into said first rectangular waveguide.

* * * * *